US007885557B2

(12) United States Patent
Harris

(10) Patent No.: US 7,885,557 B2
(45) Date of Patent: Feb. 8, 2011

(54) THERMISTOR ISOLATION TECHNIQUE FOR A CERAMIC FUSER HEATER

(75) Inventor: Steven Jeffrey Harris, Frankfort, KY (US)

(73) Assignee: Lexmark International, Inc., Lexington, KY (US)

( * ) Notice: Subject to any disclaimer, the term of this patent is extended or adjusted under 35 U.S.C. 154(b) by 225 days.

(21) Appl. No.: 12/336,314

(22) Filed: Dec. 16, 2008

(65) Prior Publication Data

US 2010/0150595 A1 Jun. 17, 2010

(51) Int. Cl.
*G03G 15/20* (2006.01)

(52) U.S. Cl. ..... 399/33; 399/88; 399/320; 399/328; 219/216; 219/486; 219/501; 219/619

(58) Field of Classification Search ..... 399/33, 399/88, 320, 328; 219/216, 486, 501, 619
See application file for complete search history.

(56) References Cited

U.S. PATENT DOCUMENTS 6,037,576 A * 3/2000 Okabayashi et al. ..... 219/619
6,097,904 A * 8/2000 Tsuruno et al. ..... 399/33
6,111,230 A * 8/2000 Cao et al. ..... 219/501
6,879,803 B2 4/2005 Gogate et al.
2003/0059224 A1* 3/2003 Tomita et al. ..... 399/88
2004/0232137 A1* 11/2004 Cook et al. ..... 219/486

OTHER PUBLICATIONS

Sahlsten, "Circuit Transfers Resistance Value Through Isolation Barrier," Electronic Design Magazine, Penton Media, Inc., Apr. 24, 2008.

* cited by examiner

*Primary Examiner*—David P Porta
*Assistant Examiner*—Casey Bryant

(57) ABSTRACT

An electrically isolated temperature sensor for use with a printer, copier, or all-in-one fuser. The fuser includes an AC driven heater to which a thermistor is mounted for sensing the temperature of the fuser heater. A resistance of the thermistor controls the period of a periodic signal generated by an astable multivibrator. An optical isolator isolates the printer fuser from down line processing circuits, and transfers the periodic signal to such processing circuits. The printer fuser employs a separate floating ground that is not connected to other DC circuits of the printer. With this arrangement, any AC power that is inadvertently coupled from the heater to the DC circuits of the fuser is isolated thereto. The AC power is isolated to the fuser and cannot be propagated through the fuser to other down line circuits of the printer.

20 Claims, 2 Drawing Sheets

| TEMP | RESISTANCE | PERIOD | PRINTER STATUS |
|---|---|---|---|
| -16°C | 2M | 1,204 MS | THERMISTOR OPEN OR "TOO COLD" |
| 10°C | 650K | 387 MS | LOWEST OPERATING AMBIENT TEMP |
| 25°C | 363K | 217 MS | NOMINAL STARTING OPERATING TEMP |
| 100°C | 37K | 22 MS | STANDBY TEMP |
| 190°C | 5.9K | 3.815 MS | LOW END FUSING TEMP |
| 230°C | 3.18K | 2.191 MS | HIGH END FUSING TEMP |
| 264°C | 2.0K | 1.497 MS | TOO HOT - TURN OFF FUSER |

THERMISTOR ISOLATION TECHNIQUE FOR A CERAMIC FUSER HEATER

CROSS REFERENCES TO RELATED APPLICATIONS

None.

BACKGROUND

1. Field of the Invention

The present invention relates generally to laser printers, copiers and all-in-one devices, and more particularly to toner fusers for use with such printers.

2. Description of the Related Art

In laser type printers, toner particles are electrostatically attracted to a print media, such as paper, to produce text, symbols or other images. The toner particles must be fused to the paper in order to make the text or image permanent and resistant to smudging or smearing. Once the toner particles are electrostatically attracted to the print media in the pattern of the text or image, the toner is fused to the print media through the use of high temperatures and pressure applied to the toner in order to permanently imbed the toner into the print media, or on the surface thereof. As can be appreciated, the temperature to which the toner is subjected must be controlled in order to assure a consistent, quality print job. The fusing temperature can change as a function of changes in parameters such as paper weight, duration of printing, etc. Fusing temperatures higher than necessary can cause the toner to fuse to some of the printer apparatus, such as the fuser belt. A fusing temperature that is too low will result in inadequate fixing of the toner to the print media, thus allowing smearing of the text or image. The fusing temperature of the toner must thus be automatically adjusted in order to maintain an optimum print quality.

Several types of fusers are known in the art for fixing the toner particles to the print media. One type of fuser employs an axial lamp to generate the power necessary to fuse the toner to the print media. Another type of fuser includes a flat ceramic slab heater with a heating resistor on one side of the ceramic member and a thermistor on the back side of the heater member. The thermistor functions to sense the temperature of the ceramic member and through feedback control circuits, control the electrical energy applied to the heating resistor and thereby control the temperature at which toner fusing occurs. Typically, the heater comprises one or more strips of a metallic material that becomes heated when an electrical current passes therethrough. Generally, the heater strip is driven by a source of AC electricity that is controlled in some manner in order to control the amount of thermal energy generated by the heater strip.

The use of the ceramic slab type of fuser heater is advantageous as there is a high speed transfer of heat from the heater, through the ceramic slab, to the print media. The faster the heat can be transferred to the print media, the more quickly the printer can commence printing. The time many printers must wait until the fuser is sufficiently hot to commence printing the first sheet of print media can be 10-20 seconds. The faster the printer can start printing, the more efficient the printer becomes. The ceramic slab heater technology is often referred to as "instant on" fusing technology. This is desirable because the time to first print is on the order of 10 seconds, or less.

In order to efficiently transfer thermal energy, the ceramic slab of the heater is constructed as a thin member, on the order of about 0.5 mm to about 2.0 mm. This construction facilitates a low thermal mass and thus can be quickly heated to the desired operating temperature. The thin construction of the ceramic slab permits the temperature sensor to be located in close proximity to the heated side of the slab heater, thereby permitting more accurate control of the temperature, and shorter response times to reach desired fuser temperature.

As noted above, the heating element located on one side of the ceramic slab heater is normally driven by the AC line voltage having a magnitude of either 120 Vrms or 240 Vrms. The thermistor is located on the opposite side of the ceramic slab heater, and is connected to low voltage circuits (5VDC) of the printer fuser. Accordingly, both the AC power line voltage circuits and the low DC voltage circuits exist in close proximity to each other in the fuser assembly. The thin ceramic slab member functions as an electrical insulator between the AC and DC circuits. As can be appreciated, it is highly desirable to maintain adequate electrical isolation between the AC power line circuits and the DC circuit of the printer, otherwise substantial damage can occur if the AC line current is allowed to be imposed on the DC circuits of the printer. A failure in the ceramic slab, such as cracking thereof, can allow the AC energy of the heater apparatus to be effectively connected to the low voltage DC circuits of the fuser. Unless isolated, the AC energy can propogate from the DC circuits of the fuser to the other down line circuits of the printer. As noted above, the AC and DC circuits of the fuser are separated from each other by only 1 mm, or so, i.e., the thickness of the ceramic slab.

Various AC/DC isolation schemes for fusers have been proposed in the laser printer field. One electrical isolation technique involves the use of a 1:1 transformer to isolate the thermistor from the AC line voltage. See *Electronic Design* magazine, Apr. 22, 2008, article entitled "Circuit Transfer Resistance Value through Isolation Barrier," by Leo Sahlsten. With this technique, the magnetic coupling between the primary and secondary of the transformer provides the electrical isolation. The disadvantage with this method is that the scope of the resistance change in the thermistor is small, namely about 1.5 decades of resistance change. This obviously limits the accuracy and/or overall range by which temperature changes can be sensed. A much better AC/DC isolation technique would allow detection of 4+ decades of thermistor resistance change, namely from about 2.4E6 Ohms (cold or nearly open) to about 2.1E3 Ohms (over temperature).

Another technique for providing electrical isolation between the AC and DC circuits of the fuser of a laser printer involves the use of capacitive coupling therebetween. With this technique, a capacitor, such as a Y-cap, is allowed to be connected between the AC line voltage and the low voltage DC circuits. Again, this method fails to allow 4+ decades of resistance change in the thermistor to be accurately and efficiently detected.

Yet another method of providing AC/DC isolation in printer fuser apparatus involves the use of optical techniques to couple light energy to the thermistor. While this provides ideal electrical isolation between the AC circuits and the DC circuits, the problem is the inability to effectively provide sufficient electrical energy to power the thermistor in order to obtain a voltage therefrom representative of the temperature. Stated another way, there is insufficient power available in the optical signals so that when transferred through an opto-isolator, the resulting electrical energy will not adequately energize the thermistor.

From the foregoing, it can be seen that a need exists for a printer fuser that can provide sufficient DC power to power the circuits thereof, and provide output electrical signals representative of the fuser temperature, all electrically isolated from other DC circuits of the printer. Another need exists for a printer fuser that is isolated from the other circuits of the printer by a separate ground system. Yet another need exists for an improved printer fuser employing temperature conversion circuits where multiple decades of temperature changes can be converted into multiple decades of resistance values to thereby provide increased temperature measuring accuracy.

SUMMARY OF THE INVENTION

A fuser assembly is disclosed which provides a temperature sensing system for measuring fuser temperatures and for converting the sensed temperature into a corresponding periodic signal having a period representative of the fuser temperature. The temperature sensing system is isolated from the AC drive system that drives the fuser heater, and is isolated from the other down line DC printer circuits that receive and process the periodic signals to control the AC drive to the fuser heater.

According to a feature of the invention, the temperature sensing system is isolated from the AC drive system by magnetic coupling, and the periodic signals representative of the fuser temperature are optically coupled to the down line processing circuits. The temperature sensing fuser circuits are thereby isolated from both the associated AC power and down line DC printer circuits.

According to yet another feature of the invention, the temperature sensing system of the fuser is constructed so that four decades of temperature change are converted into about three decades of periods of a digital pulse train.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
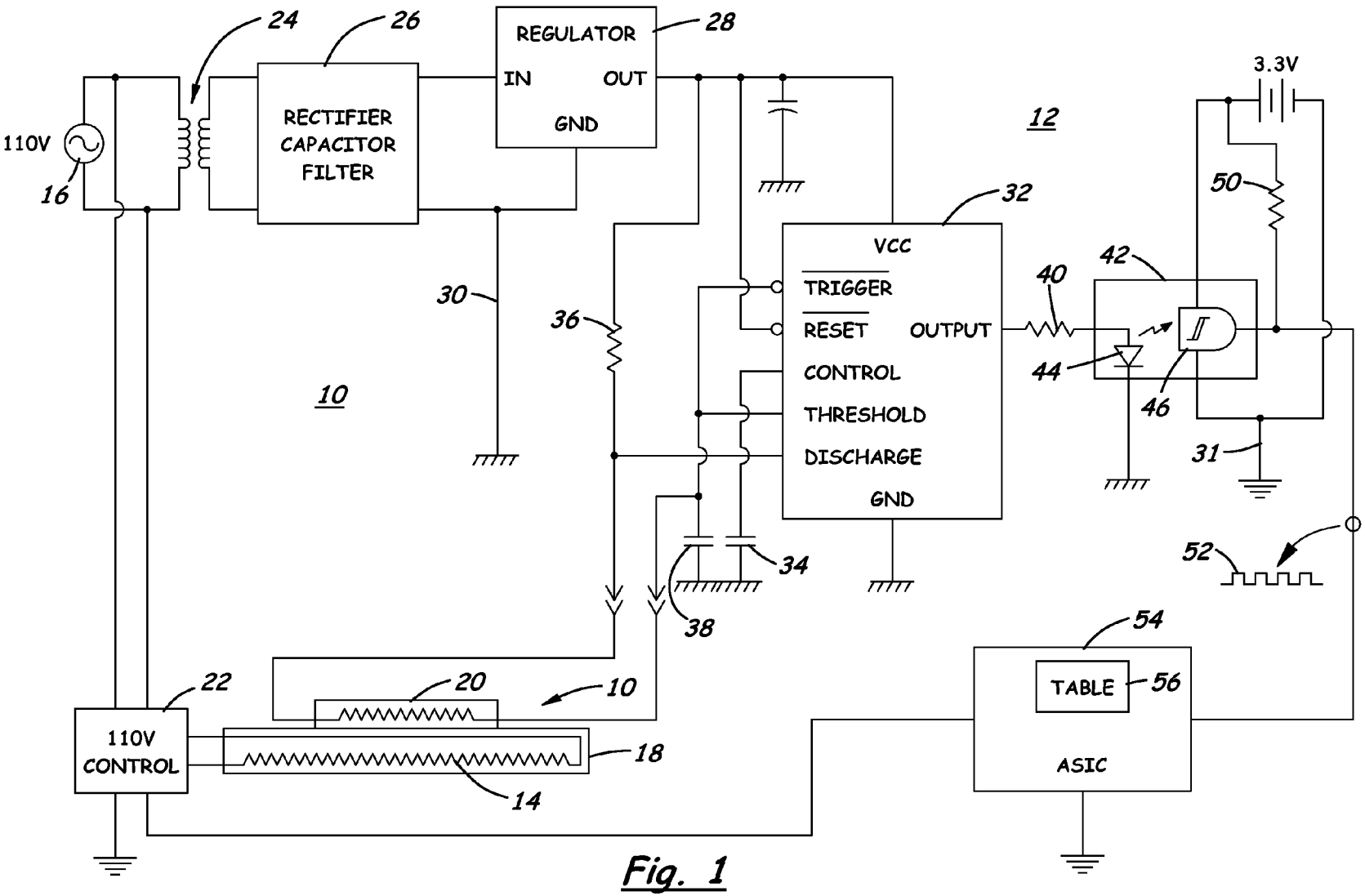
FIG. 1 is an electrical schematic diagram of one embodiment constructed according to the invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

The term image as used herein encompasses any printed or digital form of text, graphic, or combination thereof. The term output as used herein encompasses output from any printing device such as color and black-and-white copiers, color and black-and-white printers, and so-called "all-in-one devices" that incorporate multiple functions such as scanning, copying, and printing capabilities in one device. Such printing devices may utilize ink jet, dot matrix, dye sublimation, laser, and any other suitable print formats.

The present invention provides a system and method for sensing the temperature of a fuser and providing a corresponding cyclical signal representative of the same. The temperature sensing system is isolated from the AC line that drives the fuser heater. FIG. 1 illustrates an embodiment of a printer fuser 10 and associated temperature sensing system 12 for sensing the temperature of the fuser heater 14, and maintaining the heater 14 at a desired temperature. A source 16 of AC power, which may be 120Vrms, 240Vrms, or other AC line voltage source, is employed to supply AC energy to the fuser heater 14. The AC power source 16 can be the AC power plug of the printer. The fuser heater 14 can be a resistive conductor which is heated when the AC energy passes therethrough. In one embodiment of the invention, the resistive conductor of the heater 14 is located on one side of a ceramic slab 18, and a temperature sensor 20 is located on the other side of the ceramic slab 18. The temperature sensor 20 can be a thermistor which provides an output resistance as a function of the temperature of the body of the thermistor device 20. The thermistor 20 is mounted to the ceramic slab 18 so as to be in intimate thermal contact therewith.

As is well known in the art, the heat generated in the ceramic slab 18 fuses toner particles deposited on a print media that passes under the ceramic slab 18. The principles and concepts of the invention can be employed in color electrophotographic printers of the type illustrated and described in U.S. Pat. No. 6,879,803 by Gogate et al., the disclosure of which is incorporated herein by reference. The amount of AC power applied to the fuser heater 14 is controlled by a control 22 which permits sufficient energy to be coupled to the fuser heater 14 to maintain a desired temperature and thereby provide optimum fusing of the toner particles to the print media. It is to be noted that the desired operating temperature of the fuser heater 14 may change dynamically depending on the print job to be carried out, and changed during the specific print job. The AC control 22 can be a solid state switch controlled by a processor of the printer to apply or remove the AC signal with respect to the heater 14. Alternatively, the control 22 can be a circuit that controls the duty cycle of the AC signal so that only a portion of each AC cycle is applied to the fuser heater 14. It is understood that the portion of each AC cycle allowed to be applied to the fuser heater 14 is increased when it is desired to increase the thermal energy imparted to the ceramic slab 18, and vice versa. Many other conventional AC control circuits can be employed.

If the circuits controlling the AC control system 22 become defective, or if the solid state switches in the AC control circuit 22 become short circuited, then the AC energy may be continuously applied to the fuser heater 14, thereby generating excessive heat. As a result, the ceramic slab 18 to which the fuser heater 14 is attached, can crack or otherwise break. The AC line current can thus be coupled through the broken ceramic slab 18 to the thermistor 20 and to the electrical circuits of the fuser associated therewith.

From the foregoing, it can be seen that unless the DC voltage circuits of the printer fuser 10 are isolated from the AC circuits, a failure in the ceramic slab 18 can present the potential of allowing the AC power that drives of the heater 14 to be coupled through the DC fuser circuits to other down line printer circuits and cause overall catastrophic printer damage. According to a feature of the invention, the damage caused by the inadvertent imposition of the AC line power on the DC fuser circuits is limited only to the DC fuser circuits, which are modular in form and can be replaced. As noted above, the ceramic slab 18 may be no thicker than 1 mm, or so, and thus the physical separation between the fuser heater 14 and the thermistor 20 is very small. As noted above, with such a small physical separation between the AC and DC fuser circuits, even if not in physical contact, the 120VAC potential on the fuser heater 14 can arc through a crack in the ceramic slab 18 and place such potential on the thermistor 20 and the other DC circuits electrically connected therewith.

Reference is now made to the construction and operation of the fuser assembly of FIG. 1. The 120 volt, 50-60 Hz, AC signal from the power source 16 is coupled not only to the control circuit 22 which drives the fuser heater 14, but to the primary of a transformer 24. The transformer 24 has a low voltage secondary, such as 5-24VAC. A transformer with a 24VAC secondary winding is selected according to a preferred embodiment of the invention, although other output AC voltages can be employed with equal effectiveness. In accordance with an important feature of the invention, the transformer 24 provides both physical and DC isolation between the primary and secondary. Only a magnetic coupling exists between the transformer primary and secondary. The transformer secondary is connected to a rectifier circuit and filter capacitor, collectively shown as circuit 26. The output of the rectifier/filter circuit 26 is generally a DC voltage, with some possible ripple. Those skilled in the art can readily appreciate that the rectifier/filter circuit 26 is well known in the art. The output of the rectifier/filter 26 can include a threshold device so that the downstream circuits of the temperature sensing system 12 are not powered until the DC voltage exceeds a predefined magnitude.

The filtered output of the rectifier/filter circuit 26 is coupled to the input of a voltage regulator 28 which is of conventional design and available in integrated circuit form, such as integrated circuit LM140. The voltage regulator 28 functions to maintain the DC voltage of the temperature sensing system 12 at a predefined magnitude, and remove the residual ripple, irrespective of changes in AC line voltage. While not critical to the operation of the temperature sensing system 12, the regulated voltage is chosen in the preferred form of the invention as 5 VDC. It is important to note that the temperature sensing system 12 does not share a ground system with either the AC circuits, or with other downstream DC circuits of the printer. Rather, the DC circuits of the temperature sensing system 12 are provided with a floating common, identified by numeral 30, that is not connected to the other printer ground circuits, shown by the symbol of reference numeral 31.

The DC voltage output from the voltage regulator 28 powers an astable multivibrator 32, or oscillator, connected to provide an output digital signal with a frequency that varies as a function of the voltage across the thermistor 20. Since the thermistor 20 provides a voltage output that varies as a function of the temperature of the ceramic slab 18, the temperature sensing system 12 effectively functions to provide an output digital waveform having a frequency (or period) that varies with the temperature of the ceramic slab 18. As will be described in more detail below, this combination is responsive to a large range of temperatures of the ceramic slab 18, which are accurately converted to corresponding large range of digital signal frequencies. Indeed, it has been found that four decades of resistance changes can be represented with three decades of frequency changes. Accordingly, very small differences in the change in temperature of the ceramic slab 18 can be accurately represented by corresponding different digital signal frequencies.

The astable multivibrator 32 can be of many different designs. In the preferred embodiment of the invention, the astable multivibrator 32 is constructed using an LM 555 timer connected for astable operation. To that end, the Reset (not) input of the multivibrator 32 is connected to the VCC output of the voltage regulator 28. The Control input of the multivibrator 32 is connected through a capacitor 34 to the floating common 30. The Gnd terminal of the multivibrator 32 is connected to the floating common 30. The timing of the astable multivibrator 32 is determined by the value of the resistance of resistor 36 and thermistor 20, as well as the value of the timing capacitor 38. The resistance of the thermistor 20 has the largest affect on the output frequency of the astable multivibrator 32, while the resistor 36 is chosen to be of much smaller value so that the output frequency of the astable multivibrator 32 changes in a major way as a function of the resistance of the thermistor 20, and thus as a function of the temperature of the ceramic slab 18. The value of the timing capacitor 30 is chosen so that the output period of each cycle of the digital signal is on the order of seconds for high thermistor resistances, such as 2.4E6 Ohms, and the output period will be on the order of milliseconds for low thermistor resistances, such as 2.1E3 Ohms. In the event that the thermistor 20 becomes open circuited, or extremely cold, the output period of the astable multivibrator 32 will exceed about 1.204 s. This information can be used by the processor of the printer during diagnostics to determine a malfunction of the thermistor 20, namely an open thermistor 20. On the other hand, if a shorted thermistor 20 or overtemperature condition exists, the output period of the astable multivibrator 32 will be less than about 1.497 milliseconds, which information can be determined during printer malfunction diagnostics to determine that a shorted thermistor 20 exists. These above values assume a thermistor characteristic such as the commercially available Semitec 364 FT, resistor 36 value of 1K ohms, and capacitor 38 value of 0.43 uF.

Figures 2, 3:
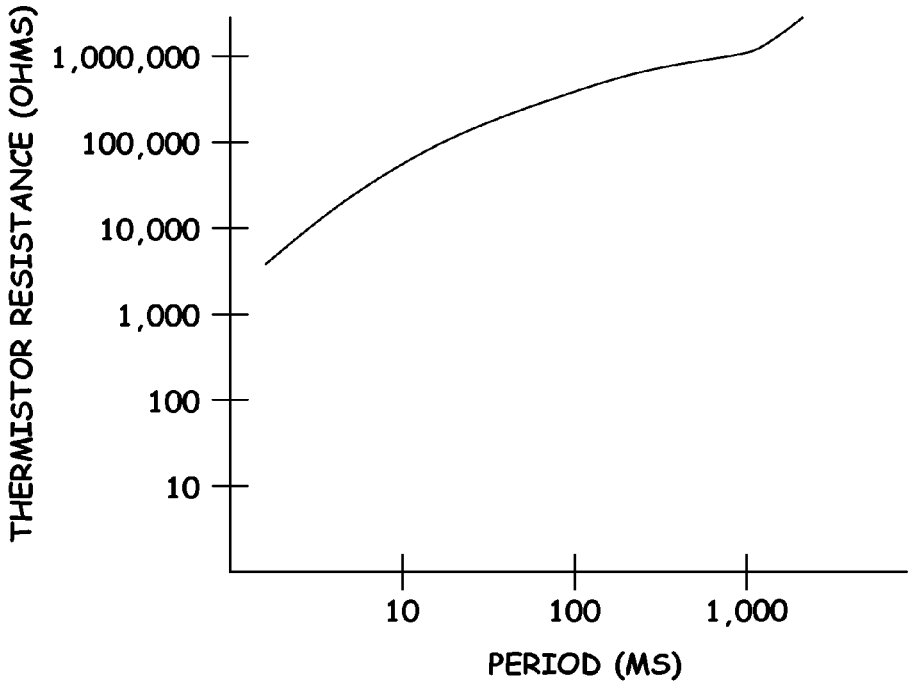
FIG. 2 is a table illustrating the relationship between the fuser temperature, resistance, pulse train period and printer status.
FIG. 3 graphically depicts the correspondence in the conversion between thermistor resistance and the period of digital signals, according to one embodiment of the invention.

In view of the foregoing, the thermistor 20 is of the type that exhibits a large range of resistances to cover the temperature range of the fuser heater 14. The table of FIG. 2 illustrates the related parameters involved in converting the temperature of the fuser heater 14 to a corresponding digital signal period, and the related printer fuser status. As can be seen, the range of fuser temperatures sensed is between −16° C. and 250° C., and the thermistor resistance varies from about 2M Ohm to about 2.4K Ohm, almost a four decade change. In the temperature sensing system 12, the multivibrator 32 can provide pulse periods that can be distinguished to 1 microsecond, or better, (due to a timer in ASIC 54) which allows very small temperature changes to be sensed.

The output of the astable multivibrator 32 is coupled through a current limiting resistor 40 to an opto-isolator 42. The opto-isolator 42 is of the type that is high speed, with fast rise and fall times (less than about 0.1 microseconds) of signals coupled therethrough. This is advantageous so that the period of the digital signals output from the astable multivibrator 32 can be accurately determined, and the corresponding temperature of the ceramic slab 18 ascertained. In the preferred embodiment, the opto-isolator 42 is of the type H11L1, while other high speed opto-isolators can be employed with equal effectiveness.

The opto-isolator 42 functions not only to convey the output temperature-related signals from the temperature sensing system 12 to the other down line printer circuits, but also to provide electrical isolation for the temperature sensing system 12. It is noted that the only coupling between the diode 44 and the output device 46 of the opto-isolator 42 is optical in nature. The output of the device 46 is connected to 3.3 VDC through a load resistor 50. The output of the temperature sensing system 12 is thus a digital signal train 52 having a magnitude of about 3 volts, where the frequency or period of the pulses is representative of the temperature of the ceramic slab 18. It can be seen that because of the optical isolation, any AC power line energy present in the DC circuits of the fuser cannot propagate to other down line DC printer circuits.

The period of the digital pulse train 52 can be determined in a number of conventional ways. A down line ASIC circuit 54 can be employed to respond to successive rising edges or falling edges of the digital waveform 52 and determine the cyclical period using a table. Alternatively, a programmed processor (not shown) can be programmed with software to respond to the successive rising or falling edges, and with the time period, consult a table to find a corresponding temperature. A look-up table 56 programmed in the ASIC 54 or processor can be readily designed by those skilled in the art by incrementally raising the temperature of the thermistor 20 by known increments (such as 1° C.), and noting the corresponding digital signal period. This information can be stored in the table 56. Nonlinearities in the temperature conversion process thus become less of a problem. If desired any nonlinearity between the fuser temperature and the digital signal period can be compensated for by corresponding software functions that are adapted for removing the same.

The circuits of the ASIC 54 can be programmed to store predefined fuser temperatures for different operating conditions. The ASIC 54 can continuously monitor the fuser temperature by processing the periods of the pulse train 52, and compare the monitored fuser temperature with the predefined temperatures. If the fuser temperature requires changing, the ASIC 54 provides a feedback signal to the AC control 22 to drive the fuser heater 14 in a manner to achieve the desired temperature.

With reference to FIG. 3 of the drawings, there is illustrated the correspondence between the range of resistances of the thermistor 20 and the period of the digital signals output by the astable multivibrator 32. A low thermistor resistance of 1,654 Ohm is converted to a digital signal with a period of 1.284 ms. A high thermistor resistance of 4,000,000 Ohms is converted to a digital signal having a period of 2,384 ms. Thus, a four decade change in resistance of the thermistor 20 is mapped or converted into a corresponding three decade change in the period of the digital signal output from the astable multivibrator 32. The particular conversion correspondence between resistance and digital signal period shown in FIG. 3 is merely exemplary and is not a necessity to the operation of the fuser temperature sensing system 12.

While the preferred embodiment of the invention has been disclosed, other variations are readily possible. For example, the temperature conversion process does not require a digital signal train, but may employ the period of an AC signal generated by a voltage controlled analog oscillator. In addition, while the features of the invention have been described in connection with a printer, the principles and concepts of the invention can be employed as well in copiers, all-in-one fusers and other reproduction equipment.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A printer fuser, comprising:

a fuser heater;

a power source for heating said fuser heater;

a temperature sensor for sensing a temperature of said fuser heater, said temperature sensor adapted for converting the temperature of said fuser heater to an electrical parameter;

an electrical circuit responsive to said electrical parameter for converting said electrical parameter to a corresponding periodic electrical signal having a period representative of said electrical parameter; and an optical circuit receiving said periodic electrical signal and converting said periodic electrical signal to a corresponding periodic optical signal, thereby providing electrical isolation to said printer fuser.

2. The printer fuser of claim 1 wherein said power source comprises an AC power line, and further including a transformer for coupling power of said AC power line to said printer fuser, and further including a circuit for converting the AC power to a DC supply voltage.

3. The printer fuser of claim 2 wherein said electrical circuit includes an astable multivibrator circuit powered by said DC supply voltage, wherein said astable multivibrator circuit is adapted for providing said periodic electrical signals.

4. The printer fuser of claim 3 wherein said temperature sensor comprises a device responsive to temperature for providing a corresponding resistance, and wherein said astable multivibrator circuit is responsive to said resistance for providing a corresponding period of said periodic signal.

5. The printer fuser of claim 1 further including a ceramic slab heated by said fuser heater, and said temperature sensor is mounted to said ceramic slab to sense a temperature thereof.

6. The printer fuser of claim 1 wherein said power source comprises an AC power source, and further including an AC control circuit for controlling the AC power source and an amount of AC power coupled to said fuser heater, and further including a transformer adapted for providing AC power to be converted to a DC voltage, whereby said AC power source provides AC power to said fuser heater via said AC control circuit, and provides AC power to said transformer.

7. The printer fuser of claim 1 wherein said temperature sensor is adapted for providing output resistances in a range of three decades, and said electrical circuit is adapted to provide periods of said periodic signals in a range of three decades.

8. The printer fuser of claim 1 further including a floating common connected only to DC circuits of said printer fuser.

9. The printer fuser of claim 1 further including a processing circuit for processing the periodic electrical signals to determine a fuser temperature, and controlling the power source to achieve a desired fuser temperature.

10. A printer fuser, comprising:

a DC power supply including an input transformer, said DC power supply adapted for converting an AC power signal to a DC voltage;

a ceramic slab for heating a print media to fuse toner thereto;

a thermistor mounted to said ceramic slab for sensing a temperature thereof and providing a corresponding output resistance;

a heater mounted to said ceramic slab, said heater driven by an AC power source;

an oscillator powered by said DC voltage, said oscillator responsive to the resistance of said thermistor for providing a periodic signal having a period corresponding to said resistance; and an optical isolator for transferring said periodic signal from said printer fuser to a down line signal processing circuit.

11. The printer fuser of claim 10 further including in combination a down line processing circuit adapted for converting the period of said periodic signal to a corresponding temperature, said processing circuit adapted to control the AC power coupled to said heater to thereby control the temperature of the ceramic slab of said printer fuser.

12. The printer fuser of claim 10 wherein said oscillator comprises an astable multivibrator that generates a periodic digital signal.

13. The printer fuser of claim 12 wherein said astable multivibrator includes an RC network that determines a period of said periodic signal, and a resistance of said RC network comprises the output resistance of said thermistor.

14. The printer fuser of claim 10 further including a voltage regulator for regulating a voltage output by said DC power supply.

15. The printer fuser of claim 10 further including a floating common providing a ground only for circuits of said printer fuser, and not providing a ground connected to other printer circuits.

16. The printer fuser of claim 10 further including a table storing different periods of said periodic signals, where said different periods are associated in said table with respective temperatures of said ceramic slab.

17. A method of controlling a fuser temperature in a printer, comprising:

using a thermistor to sense a temperature of the fuser to provide a corresponding resistance;

using a value of the thermistor resistance to generate a periodic electrical signal having a period that changes as a function of said thermistor resistance, whereby the period of said periodic electrical signal defines the temperature of said fuser;

optically isolating the fuser from down line processing circuits, and transferring the periodic electrical signals to the down line processing circuits; and processing the periodic electrical signal to define a period thereof to determine a corresponding temperature of said fuser.

18. The method of claim 17 further including using a floating common to which circuits of said fuser are connected, and not connecting the floating common to the down line processing circuits.

19. The method of claim 17 further including converting a temperature range of at least four decades into a range of resistances of at least about three decades.

20. The method of claim 17 further including preventing any AC power which is inadvertently coupled to the DC circuits of the fuser from being coupled therefrom to the down line processing circuits of the printer.

* * * * *